US007770548B2

(12) United States Patent
Yamagata

(10) Patent No.: US 7,770,548 B2
(45) Date of Patent: Aug. 10, 2010

(54) COOLING STRUCTURE OF CYLINDER HEAD

(75) Inventor: Mitsumasa Yamagata, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 364 days.

(21) Appl. No.: 12/063,242

(22) PCT Filed: Aug. 17, 2006

(86) PCT No.: PCT/JP2006/316186

§ 371 (c)(1),
(2), (4) Date: Feb. 8, 2008

(87) PCT Pub. No.: WO2007/020982

PCT Pub. Date: Feb. 22, 2007

(65) Prior Publication Data

US 2009/0133647 A1 May 28, 2009

(30) Foreign Application Priority Data

Aug. 19, 2005 (JP) ..... 2005-238405

(51) Int. Cl.
*F02F 1/40* (2006.01)

(52) U.S. Cl. ..... 123/41.82 R; 123/41.74

(58) Field of Classification Search ..... 123/41.72, 123/41.74, 41.82 R, 41.82 A, 193.5
See application file for complete search history.

(56) References Cited

U.S. PATENT DOCUMENTS 3,491,731 A * 1/1970 Deutschmann et al. ... 123/41.82 R

FOREIGN PATENT DOCUMENTS

| | | |
|---|---|---|
| JP | 61 138862 | 6/1986 |
| JP | 87 12661 | 10/1987 |
| JP | 5 26108 | 2/1993 |
| JP | 2526038 | 11/1996 |
| JP | 10 299570 | 11/1998 |
| JP | 2003 184644 | 7/2003 |
| JP | 2005 155492 | 6/2005 |
| JP | 2005 535819 | 11/2005 |

* cited by examiner

*Primary Examiner*—Noah Kamen
(74) *Attorney, Agent, or Firm*—Oblon, Spivak, McClelland, Maier & Neustadt, L.L.P.

(57) ABSTRACT

A coolant passage in a cylinder head of a multi-cylinder internal combustion engine is divided into an intake-side passage below intake ports and extending in a cylinder arranging direction, and an exhaust-side passage including plural exhaust-side lateral passages corresponding to respective cylinders and an exhaust-side longitudinal passage. The exhaust-side lateral passages (1) are mutually separated by partition walls at a position corresponding to the section between a corresponding adjacent pair of the cylinders, (2) have an inlet for coolant in the vicinity of exhaust ports of a corresponding one of the cylinders, and (3) extend from the inlet toward the intake port via the vicinity of a top of a combustion chamber formed in the corresponding cylinder. The exhaust-side longitudinal passage extends along the cylinder arranging direction. Downstream ends of the exhaust-side lateral passages connect to the exhaust-side longitudinal passage.

5 Claims, 4 Drawing Sheets

COOLING STRUCTURE OF CYLINDER HEAD

TECHNICAL FIELD OF THE INVENTION

The present invention relates to a cooling structure of a cylinder head of a multi-cylinder internal combustion engine.

DISCUSSION OF THE BACKGROUND ART

Conventionally, various types of cooling structures with improved cooling performance for a cylinder head of a multi-cylinder internal combustion engine have been proposed. For example, Patent Document 1 discloses a cooling structure in which a coolant passage in a cylinder head is divided into an intake-side passage and an exhaust-side passage, and the exhaust-side passage is divided into exhaust-side lateral passages and an exhaust-side longitudinal passage. The intake-side passage is arranged below intake ports and extends along the arranging direction of cylinders. Each of the exhaust-side lateral passages is provided between a corresponding adjacent pair of the cylinders and extends along a direction substantially perpendicular to the arranging direction of the cylinders. A coolant inlet of each exhaust-side lateral passage is arranged between the corresponding adjacent cylinders and in the vicinity of the intake-side passage. The exhaust-side longitudinal passage is provided in the vicinities of exhaust ports and extends in the arranging direction of the cylinders. The downstream end of each exhaust-side lateral passage is connected to the exhaust-side longitudinal passage.

In the cooling structure, a sufficient flow of low-temperature coolant is sent from a radiator to the intake-side passage. The coolant thus cools the intake air flowing through the intake ports, suppressing knocking. Further, since an upstream side of the exhaust-side passage is formed by the exhaust-side lateral passages, a sufficient amount of coolant is provided to heated portions corresponding to the sections between the cylinders. The heated portions are thus efficiently cooled.

Each of the exhaust-side lateral passages and the inlet of the exhaust-side lateral passage of this cooling structure of the cylinder head are provided between the corresponding adjacent pair of the cylinders. This arrangement allows the coolant flowing in the exhaust-side lateral passages to cool the portions corresponding to the sections between the cylinders and the vicinities of these portions, which are, for example, the portions in the proximities of combustion chambers. However, the cooling structure does not appropriately send the coolant to the vicinity of the top of each of the combustion chambers, which are formed in the respective cylinders. This makes it difficult for the coolant to cool, particularly, most heated portions such as a section between each adjacent pair of the exhaust ports, a section between each adjacent pair of the exhaust valves, and the proximity of the ignition plug of each of the cylinders.

Patent Document 1: Japanese Utility Model Registration No. 2526038

SUMMARY OF THE INVENTION

Accordingly, it is an objective of the present invention to reliably cool a highly heated portion in the vicinity of a top of a combustion chamber by a cooling structure of a cylinder head having a coolant passage divided into an intake-side passage and an exhaust-side passage.

To achieve the foregoing objective and in accordance with one aspect of the present invention, a cooling structure of a cylinder head of an internal combustion engine having a plurality of cylinders is provided. The cylinder head has in each of the cylinders a plurality of exhaust ports selectively opened and closed by respective exhaust valves and at least one intake port. The cylinder head includes a coolant passage. The coolant passage is divided into an intake-side passage that cools a portion of the cylinder head close to the intake ports and an exhaust-side passage that cools a portion of the cylinder head close to the exhaust ports. The intake-side passage is arranged below the intake ports and extends along a cylinder arranging direction. The exhaust-side passage includes a plurality of exhaust-side lateral passages corresponding to the respective cylinders and an exhaust-side longitudinal passage. The exhaust-side lateral passages are mutually separated by partition walls. Each of the partition walls is arranged at a position corresponding to a section between the corresponding adjacent pair of the cylinders. Each of the exhaust-side lateral passages has an inlet for a coolant provided in the vicinity of the exhaust ports of the corresponding one of the cylinders. Each exhaust-side lateral passage extends from the inlet toward the intake port via the vicinity of a top of a combustion chamber formed in the corresponding cylinder. The exhaust-side longitudinal passage extends along the cylinder arranging direction. A downstream end of each exhaust-side lateral passage is connected to the exhaust-side longitudinal passage.

DETAILED DESCRIPTION OF THE PREFERRED EMBODIMENTS

One embodiment of the present invention will now be described with reference to the attached drawings.

Figure 1:
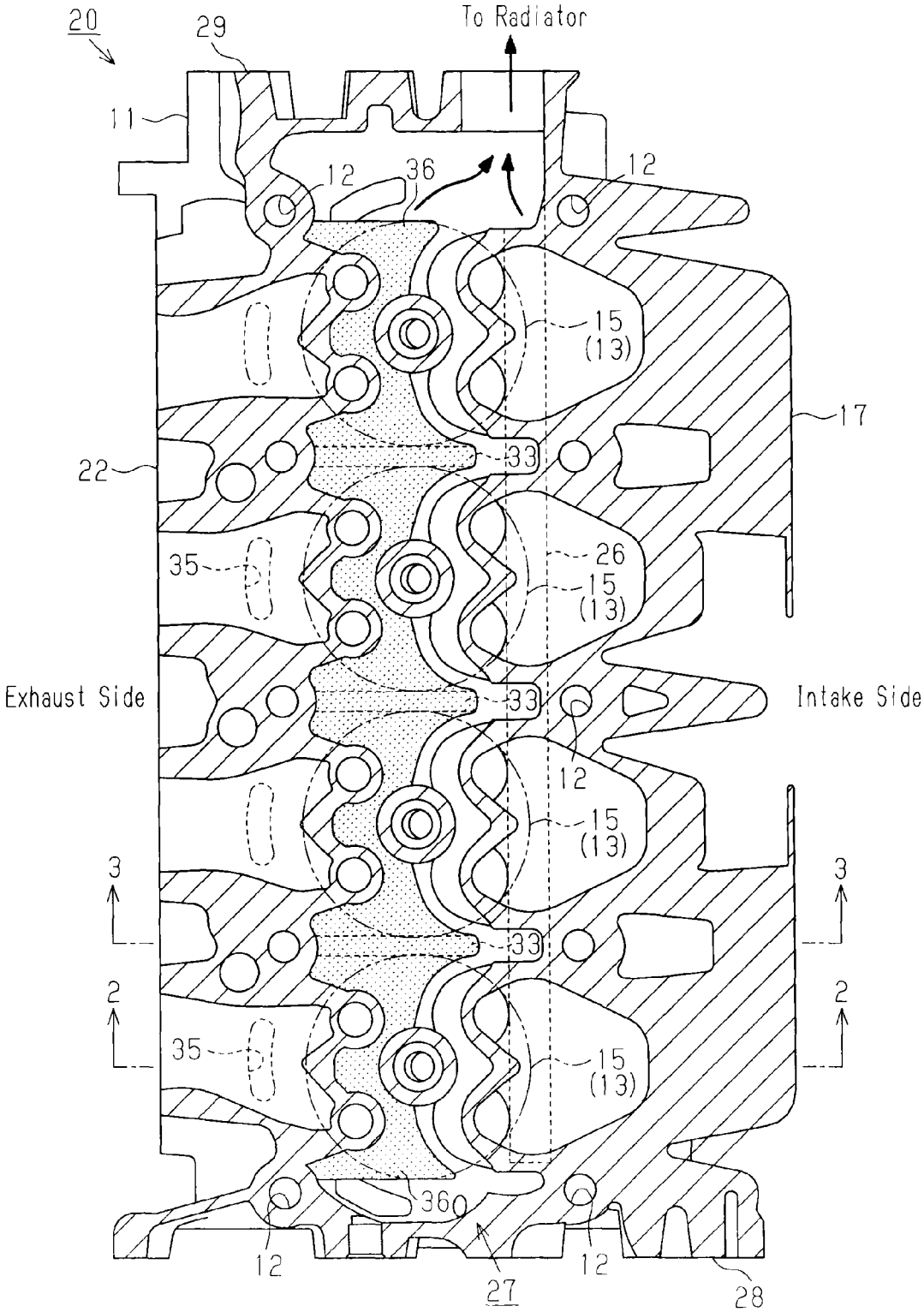
FIG. 1 is a (cross-sectional plan view showing a cylinder head according to one embodiment of the present invention.
Figure 2:
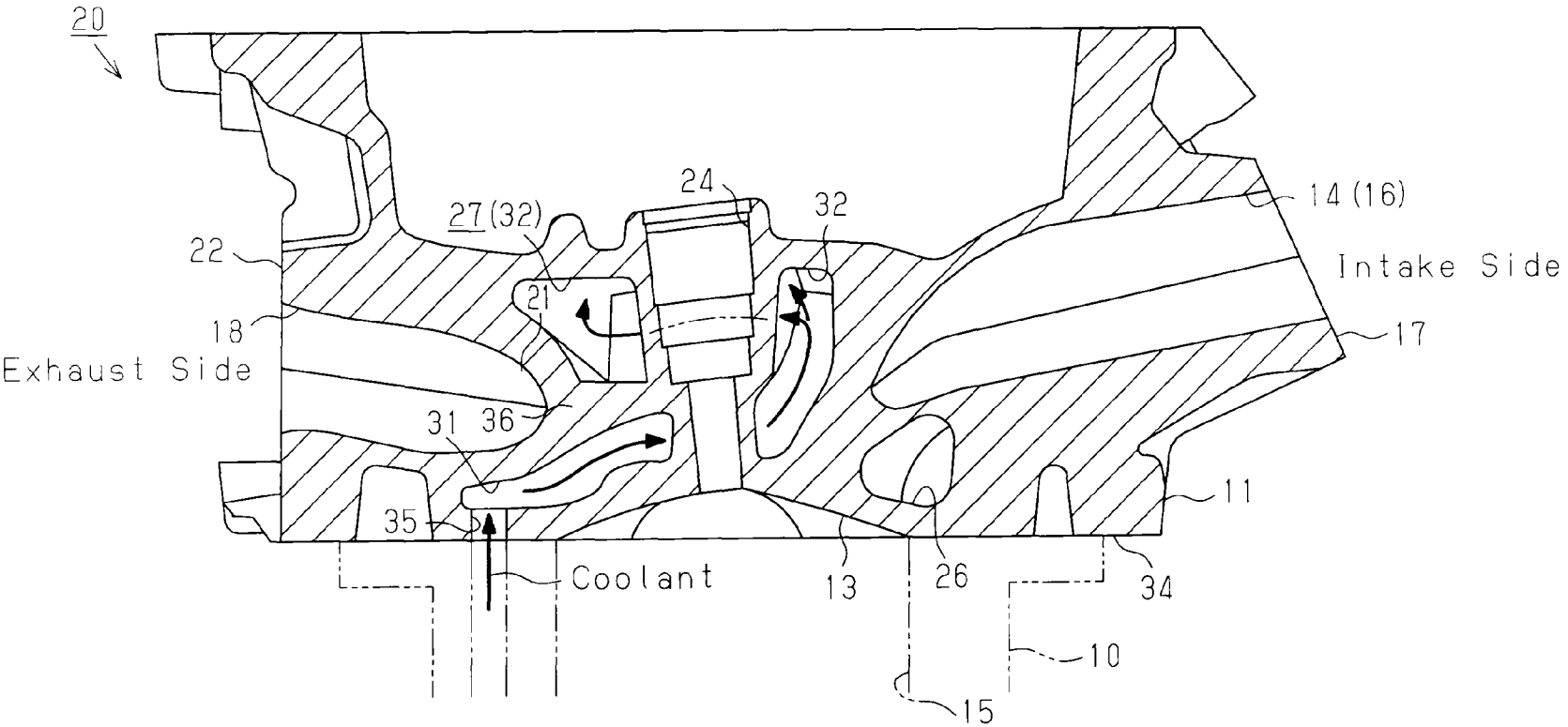
FIG. 2 is an enlarged cross-sectional view taken along line 2-2 of FIG. 1.
Figure 3:
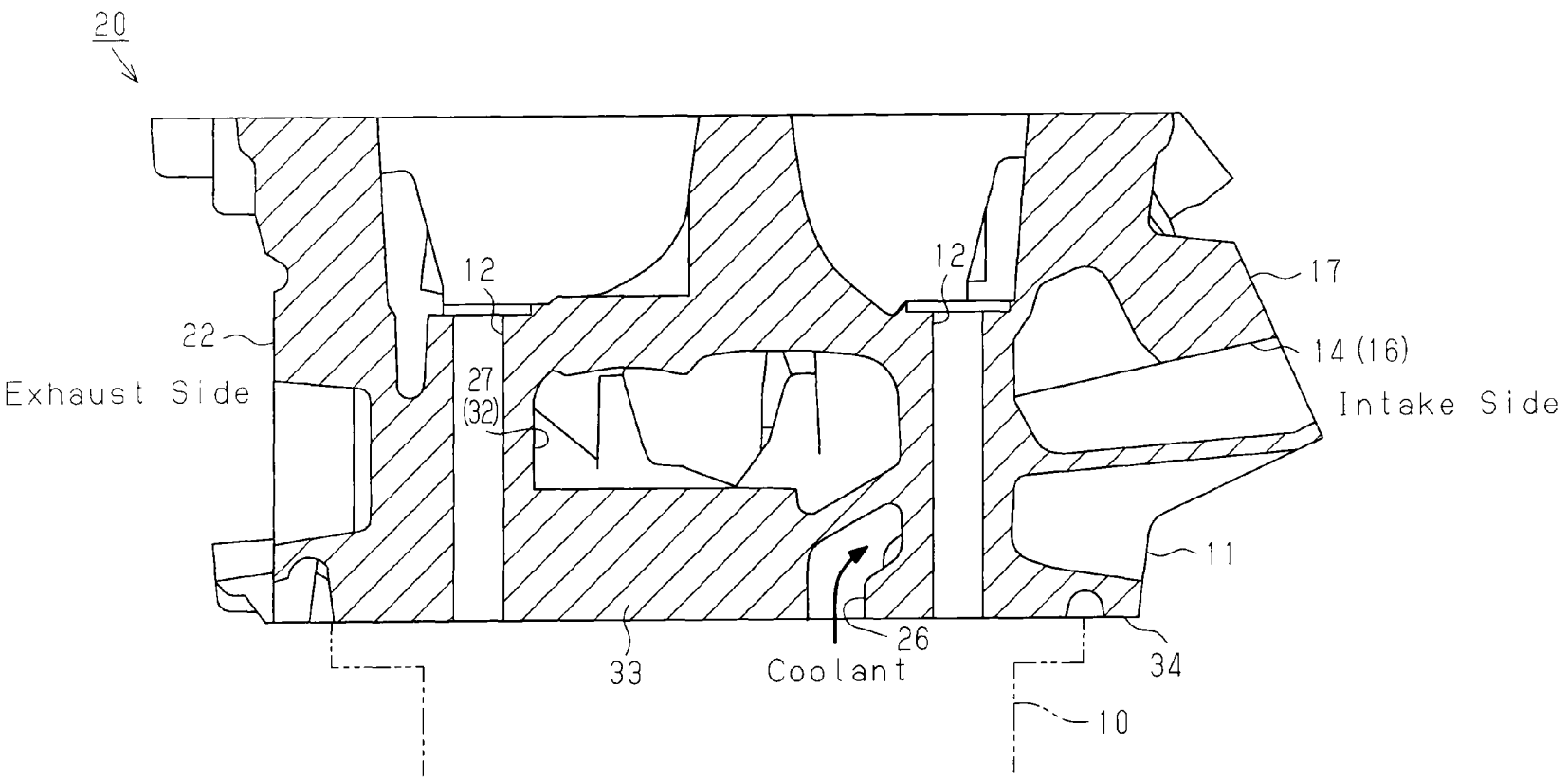
FIG. 3 is an enlarged cross-sectional view taken along line 3-3 of FIG. 1.

As shown in FIGS. 1 to 3, a gasoline engine (hereinafter, simply referred to as an engine) 20, which serves as an internal combustion engine, includes a cylinder block 10. A plurality of (in the illustrated embodiment, four) cylinders 15 are formed in the cylinder block 10 and arranged along a line. A cylinder head 11 is mounted on the cylinder block 10 and fastened to the cylinder block 10 by bolts (not shown) passed through a plurality of bolt holes 12.

Figure 4:
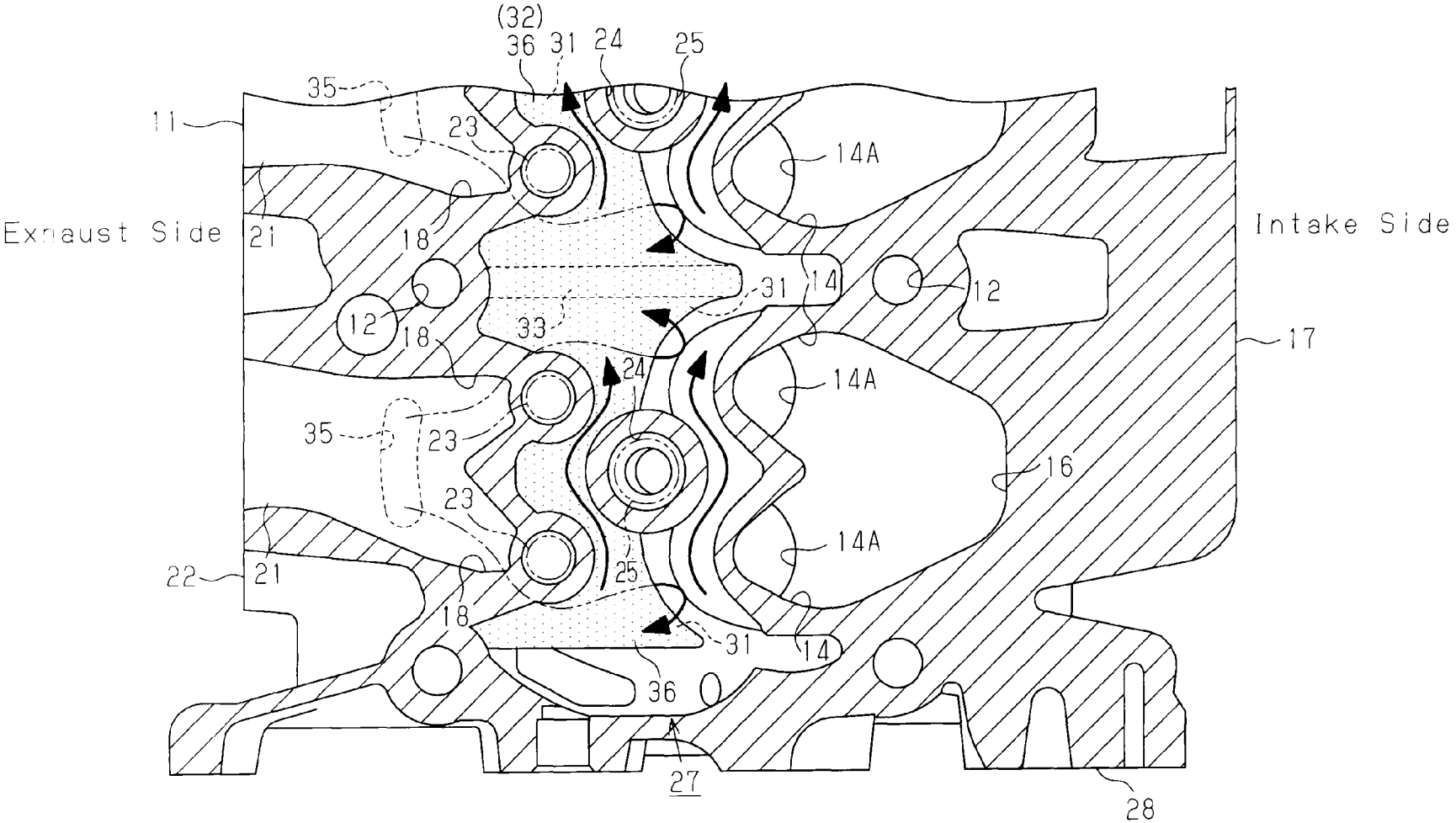
FIG. 4 is an enlarged cross-sectional plan view showing a portion of FIG. 1.

A combustion chamber 13 is formed in a bottom surface 34 of the cylinder head 11 at a position corresponding to each of the cylinders 15. With reference to FIGS. 2 to 4, a pair of intake ports 14, 14 through which intake air is fed to the corresponding one of the combustion chambers 13 are formed in the cylinder head 11 in correspondence with each of the cylinders 15. The intake ports 14, 14 corresponding to each cylinder 15 are arranged in an arranging direction of the cylinders 15. The arranging direction of the cylinders 15, or the cylinder arranging direction, extends perpendicular to the sheet surface as viewed in FIGS. 2 and 3 and vertically as viewed in FIGS. 1 and 4. The downstream ends of the intake ports 14, 14 form openings 14A, 14A, which define openings in the wall surface of the corresponding combustion chamber 13. The intake ports 14, 14 merge into each other at a position upstream from the combustion chamber 13 in the flow direction of the intake air. The upstream end of such merging point 16 forms an opening in an intake-side wall surface 17 of the cylinder head 11. Intake valves (not shown) that selectively open and close the openings 14A of the intake ports 14 are secured to the cylinder head 11 in a reciprocally movable manner.

A pair of exhaust ports 18, 18 are provided in each of the cylinders 15 of the cylinder head 11. The exhaust ports 18, 18 send exhaust gas generated in the corresponding combustion chamber 13 to the exterior of the engine 20. The exhaust ports 18, 18 of the cylinders 15 are aligned along the cylinder arranging direction. The upstream ends of the exhaust ports 18, 18 define openings in the wall surface of the corresponding combustion chamber 13. The exhaust ports 18, 18 merge into each other at a position downstream from the combustion chamber 13 in the flow direction of the exhaust gas. The downstream end of this merging point 21 forms an opening in an exhaust-side wall surface 22 of the cylinder head 11. Exhaust valves 23, which selectively open and close the openings of the corresponding exhaust ports 18, are secured to the cylinder head 11 in a reciprocating manner.

Plug securing bores 24, which extend substantially in the vertical direction, are formed in the cylinder head 11 at the positions corresponding to the tops of the combustion chambers 13. An ignition plug 25 is secured to each of the plug securing bores 24.

As air-fuel mixture burns and generates heat, the heat raises the temperatures in each combustion chamber 13 and the vicinities of the combustion chambers 13 in the cylinder head 11. Such heated portions in the vicinity of each combustion chamber 13 include the exhaust ports 18, 18, through which the exhaust gas generated in the combustion chamber 13 flows, and, particularly, the merging point 21 between the exhaust ports 18, 18. The heated portions also include the vicinities of the exhaust valves 23 (including the exhaust valves 23, 23) and the vicinities of the ignition plugs 25.

A passage through which coolant for cooling different portions of the cylinder head 11 is formed in the cylinder head 11. As illustrated in FIGS. 1 and 2, the coolant passage is divided into an intake-side passage 26, which cools portions of the cylinder head 11 at an intake side, and an exhaust-side passage 27, which cools portions of the cylinder head 11 at an exhaust side. The intake-side passage 26 is formed by a passage that is arranged below the intake ports 14, 14 of the cylinders 15 and extends along the cylinder arranging direction.

The upstream end of the intake-side passage 26 is arranged near a front surface 28 of the cylinder head 11. This upstream end forms a coolant inlet port (not shown). Specifically, coolant flows sequentially in a radiator, a water pump, the cylinder block 10, and a gasket and then reaches the coolant inlet port. A coolant passage, which is formed in the cylinder block 10 and extends to the inlet port, is relatively short. This substantially prevents heating of the coolant that has been cooled through heat dissipation in the radiator. The coolant is thus sent from the inlet port to the intake-side passage 26 in a cooled state. The downstream end of the intake-side passage 26 is located near a rear surface 29 of the cylinder head 11. This downstream end forms a coolant outlet port (not shown) through which the coolant flows out from the intake-side passage 26. The flow of the coolant discharged from the intake-side passage 26 through the outlet port merges with the flow of the coolant that has exited an exhaust-side longitudinal passage 32, which will be described later. The merged flow will be led to the radiator.

As shown in FIGS. 2 to 4, the exhaust-side passage 27 includes exhaust-side lateral passages 31 corresponding to the respective cylinders 15 and an exhaust-side longitudinal passage 32 provided commonly for the cylinders 15 (see FIG. 2). Each adjacent pair of the exhaust-side lateral passages 31 are separated from each other by a partition wall 33, which is arranged at a position corresponding to the section between the corresponding adjacent pair of the cylinders 15, 15 (combustion chambers 13, 13), in the cylinder arranging direction. Each of the partition walls 33 suppresses the flow of the coolant between the corresponding adjacent pair of the exhaust-side lateral passages 31, 31 in the cylinder arranging direction. Each partition wall 33 also regulates the flow of the coolant in the corresponding exhaust-side lateral passages 31 in a direction perpendicular to the cylinder arranging direction.

Each of the exhaust-side lateral passages 31 has an upstream end located below the merging point 21 of the exhaust ports 18, 18 of the corresponding one of the cylinders 15 and a downstream end close to the intake ports 14, 14 with respect to the lower half of the ignition plug 25.

Coolant inlets 35, which connect the bottom surface 34 of the cylinder head 11 to the exhaust-side lateral passages 31, are formed in a bottom portion of the cylinder head 11 and below the merging points 21. After having flowed in the water jacket in the cylinder block 10, the coolant is sent to each of the exhaust-side lateral passages 31 through the associated one of the inlets 35.

The exhaust-side longitudinal passage 32 is arranged above the exhaust-side lateral passages 31 and the partition walls 33 and extends along the cylinder arranging direction. The exhaust-side longitudinal passage 32 surrounds the upper half of the ignition plugs 25 of the cylinders 15. The downstream end of each exhaust-side lateral passage 31 is connected to the exhaust-side longitudinal passage 32. One side edge of the exhaust-side longitudinal passage 32 is located above the downstream ends of the exhaust-side lateral passages 31. The opposite side edge of the exhaust-side longitudinal passage 32 is arranged between the two exhaust valves 23, 23 of each cylinder 15 and in the vicinity of the merging point 21 of the exhaust ports 18, 18.

A separation wall 36 is provided between each exhaust-side lateral passage 31 and the exhaust-side longitudinal passage 32, which is located above the exhaust-side lateral passage 31. Each of the separation walls 36 extends from the vicinity of the corresponding ones of the exhaust ports 18, 18 to the associated ones of the intake ports 14, 14. An end of each separation wall 36 is arranged in the vicinity of the corresponding ignition plug 25. The separation wall 36 vertically separates the corresponding exhaust-side lateral passage 31 and the portion of the exhaust-side longitudinal passage 32 close to the exhaust ports 18, 18 with respect to the ignition plugs 25 from each other. The downstream end of each exhaust-side lateral passage 31 is connected to the exhaust-side longitudinal passage 32 at a position close to the corresponding intake ports 14, 14 with respect to the ignition plug 25.

Thus, the exhaust-side passage 27 has a two layered structure including the exhaust-side lateral passages 31, which are provided in the respective cylinders 15 and located below the separation walls 36, and the exhaust-side longitudinal passage 32, which is arranged above the separation walls 36. The separation walls 36 separate the corresponding exhaust-side lateral passages 31 from the exhaust-side longitudinal passage 32 in the vertical direction. This reduces the cross-sectional area of each exhaust-side lateral passage 31 along a plane extending along the cylinder arranging direction compared to a case of a different structure.

The exhaust-side longitudinal passage 32 is provided in portions close to the intake ports 14, 14 and portions close to the exhaust ports 18, 18 with respect to the ignition plugs 25. This increases the cross-sectional area of the exhaust-side longitudinal passage 32 along a plane extending perpendicular to the cylinder arrangement direction, compared to a case in which the exhaust-side longitudinal passage 32 is arranged in solely in the portions close to the intake ports 14, 14 or in the portions close to the exhaust ports 18, 18 with respect to the ignition plugs 25.

The above-described cylinder head 11 including the intake-side passage 26 and the exhaust-side passage 27, which serve as the coolant passage, is formed through casting. The exhaust-side lateral passages 31 and the exhaust-side longitudinal passage 32 are provided in the cylinder head 11 by placing cores in a mold for forming the cylinder head 11. Although blowholes may be formed in the cylinder head 11 through casting, it is unlikely that the wall surfaces of the exhaust-side lateral passages 31 and the wall surface of the exhaust-side longitudinal passage 32, which correspond to the surfaces of the cores, have mutually connected blowholes.

When the coolant flows in the intake-side passage 26 of the cooling structure of the cylinder head 11, which is configured as described above, the coolant is guided along the cylinder arranging direction and a path below the intake ports 14, 14 of the cylinders 15. The coolant thus cools the intake air passing through the intake ports 14, 14. The cooled intake air is drawn into the combustion chambers 13, suppressing knocking. The coolant cools the squish area in each combustion chamber 13, which also suppresses knocking. This allows advancement of the timings at which the ignition plugs 25 ignite the air-fuel mixture so as to increase the output of the engine 20. Further, by cooling the intake air in the above-described manner, the volumetric efficiency (packing efficiency) of the intake air is improved, which advantageously increases the output of the engine 20.

Particularly, in the illustrated embodiment, the coolant sent from the radiator flows sequentially through the water pump, the cylinder block 10, and the gasket and reaches the intake-side passage 26. The coolant passage provided in the cylinder block 10 is short and thus the amount of the heat received by the coolant flowing in the cylinder block 10 is small. As a result, when the coolant flows into the intake-side passage 26 after having been cooled through heat dissipation in the radiator, the temperature of the coolant is maintained at a low level without significantly increasing. This sufficiently cools the intake air flowing through the intake ports 14, 14 and the squash area of each combustion chamber 13, thus further reliably suppressing knocking.

In the exhaust-side passage 27 provided separately from the intake-side passage 26, the coolant flows as indicated by the arrows in FIGS. 2 and 4. Specifically, after having passed through the water jacket of the cylinder block 10, the coolant enters each exhaust-side lateral passage 31 corresponding to the lower layer of the two-layered structure through the inlet 35 of the corresponding cylinder 15. Each inlet 35 has an opening below and in the vicinity of the merging point 21 of the corresponding exhaust ports 18, 18. This causes the coolant to proceed below and in the vicinity of the merging point 21 of the exhaust ports 18, 18 via the inlet 35. Thus, the merging point 21, which is a particularly highly heated portion of the exhaust ports 18, 18, is thus reliably cooled.

After the coolant enters each of the exhaust-side lateral passages 31, the flow of the coolant is restricted by the partition walls 33, each of which is located at a position corresponding to the section between the corresponding adjacent pair of the cylinders 15, 15 of the cylinder head 11, and the separation walls 36 between the exhaust-side lateral passages 31 and the exhaust-side longitudinal passage 32. This causes the coolant to flow in the exhaust-side lateral passages 31 of the cylinders 15 along directions extending along the partition walls 33 and separation walls 36, or directions substantially perpendicular to the cylinder arranging direction (directions toward the intake ports 14, 14). As the coolant proceeds above each combustion chamber 13, the coolant flows in the vicinity of the corresponding exhaust ports 18, 18, the vicinity of the corresponding exhaust valves 23, 23, and the portion around the lower half of the corresponding ignition plug 25, thus cooling these portions.

As has been described, the separation walls 36 separate the exhaust-side lateral passages 31 from the exhaust-side longitudinal passage 32 in the vertical direction. The cross-sectional area of each exhaust-side lateral passage 31 along the plane extending in the cylinder arranging direction is thus small. This increases the speed of the coolant that flows in the exhaust-side lateral passage 31.

When the two (multiple) exhaust valves 23 are provided for each of the cylinders and aligned along the cylinder arranging direction, a passage extending along the cylinder arranging direction may be provided instead of the above-described exhaust-side lateral passages 31, to cool the vicinities of the exhaust ports 18, 18, the vicinities of the exhaust valves 23, 23, and the vicinities of the ignition plugs 25. In this case, a sufficient amount of coolant cannot be sent to the sections between the exhaust valves 23, 23. Contrastingly, in the illustrated embodiment, the coolant flows in each exhaust-side lateral passage 31 along the direction substantially perpendicular to the cylinder arranging direction. This ensures a sufficient amount of coolant flowing between the exhaust valves 23, 23. Thus, the portions corresponding to the sections between the exhaust ports 18, 18 and the portions corresponding to the sections between the exhaust valves 23, 23 are effectively cooled.

After having flowed in each exhaust-side lateral passage 31, the coolant proceeds beyond the corresponding separation wall 36 and reaches a portion close to the intake ports 14, 14 with respect to the ignition plug 25. The coolant then passes through the portion at which the exhaust-side lateral passage 31 is connected to the exhaust-side longitudinal passage 32 and enters the exhaust-side longitudinal passage 32, which is the upper layer of the two layered structure. The exhaust-side longitudinal passage 32 changes the flow direction of some of the coolant to the cylinder arranging direction. The coolant is thus guided along the cylinder arranging direction with little stagnation. The flow of the coolant along the cylinder arranging direction cools the portions in the vicinities of the ignition plugs 25. Particularly, since the exhaust-side longitudinal passage 32 surrounds each ignition plug 25, the heat generated by the ignition plug 25 is transmitted to the coolant flowing in the vicinity of the ignition plug 25, thus cooling the ignition plug 25.

The rest of the coolant in the exhaust-side longitudinal passage 32 proceeds along the direction opposite to the flow direction of the coolant in each exhaust-side lateral passage 31 and thus moves above each separation wall 36 toward the exhaust ports 18, 18. At this stage, some of the coolant flows around the corresponding ignition plug 25. Afterwards, the flow direction of the coolant is switched to the cylinder arranging direction. The coolant thus flows in the portions of the exhaust-side longitudinal passage 32 close to the exhaust ports 18, 18 with respect to the corresponding ignition plugs 25, cooling the exhaust ports 18, 18 and the portions in the vicinities of the exhaust ports 18, 18.

As has been described, the cross-sectional area of the exhaust-side longitudinal passage 32 along a plane perpendicular to the cylinder arranging direction is great compared to the case in which the exhaust-side longitudinal passage is provided solely in the portions close to the intake ports 14, 14 or the exhaust ports 18, 18 with respect to the ignition plugs 25. Thus, the coolant flows in the exhaust-side longitudinal passage 32 without great pressure loss.

After having reached the downstream end of the exhaust-side longitudinal passage 32, the coolant merges with the coolant that has reached the downstream end of the aforementioned intake-side passage 26, as indicated by the arrows in FIG. 1. The coolant then flows out from the cylinder head 11 and is led to the radiator.

The illustrated embodiment, which has been explained in detail so far, has the following advantages.

(1) The coolant passage in the cylinder head 11 is divided into the intake-side passage 26 and the exhaust-side passage 27. The intake-side passage 26 is arranged below the intake ports 14, 14 of each cylinder 15 and extends along the cylinder arranging direction (see FIGS. 1 and 2). Thus, a great amount of coolant is sent to the intake-side passage 26, separately from the exhaust-side passage 27. This effectively cools the intake air flowing through the intake ports 14, 14 and the squish area of each combustion chamber 13. Knocking is thus suppressed.

Particularly, although the coolant is introduced into the intake-side passage 26 via the cylinder block 10, the coolant passage in the cylinder block 10 is short. This allows the coolant to enter the intake-side passage 26 while substantially maintaining its temperature that has been decreased through heat dissipation by the radiator. Thus, the advantage (1) is further reliably ensured.

(2) The partition walls 33 are each provided at the position corresponding to the section between the corresponding adjacent pair of the cylinders 15, 15 in the cylinder head 11. A portion (an upstream portion) of the exhaust-side passage 27 is formed by the exhaust-side lateral passages 31, which are separated by the corresponding partition walls 33 for the respective cylinders 15. Further, the inlets 35 are each provide in the vicinity of the exhaust ports 18, 18 of the corresponding cylinder 15. This causes the partition walls 33 to regulate the flow of the coolant that has flowed through the corresponding inlets 35 in such a manner that the coolant flows in a direction substantially perpendicular to the cylinder arranging direction (a direction toward the intake ports 14, 14). Further, as the coolant flows in each of the exhaust-side lateral passages 31, the coolant proceeds along the vicinity of the exhaust ports 18, 18, the vicinity of the exhaust valves 23, 23, and the portion around the ignition plug 25, which are the highly heated portions in the vicinity of the top of the corresponding combustion chamber 13. These portions are thus effectively cooled.

Also, compared to a case in which the coolant flows along the cylinder arranging direction, a greater amount of coolant is introduced into the portions between the exhaust ports 18, 18 and the portions between the exhaust valves 23, 23. These portions are thus reliably cooled.

(3) Since the exhaust gas produced in each combustion chamber 13 flows through the associated exhaust ports 18, 18, the temperature in the vicinity of the exhaust ports 18, 18 rises. The temperature in the vicinity of the exhaust ports 18, 18 becomes particularly high at the merging point 21 between the exhaust ports 18, 18. However, in the illustrated embodiment, the inlet 35 is provided at a position below and in the vicinity of the merging point 21 between the exhaust ports 18, 18. This causes the coolant to proceed below and in the vicinity of the merging point 21 between the exhaust ports 18, 18 through the inlet 35. The efficiency for cooling the aforementioned highly heated portions is thus enhanced.

(4) A portion (a downstream portion) of the exhaust-side passage 27 is configured by the exhaust-side longitudinal passage 32, which is provided commonly for the cylinders 15. The exhaust-side longitudinal passage 32 extends along the cylinder arranging direction. The downstream ends of the exhaust-side lateral passages 31 of the cylinders 15 are connected to the exhaust-side longitudinal passage 32. Thus, after the coolant has passed through the exhaust-side lateral passages 31 of the respective cylinders 15, the exhaust-side longitudinal passage 32 causes the coolant to flow with little stagnation in the cylinder arranging direction. This cools the upper half of each ignition plug 25.

(5) The exhaust-side longitudinal passage 32 is arranged above the exhaust-side lateral passages 31 in such a manner that the ignition plugs 25 are surrounded by the exhaust-side longitudinal passage 32. Thus, as the coolant flows in the exhaust-side longitudinal passage 32, the coolant receives the heat from each ignition plug 25 in the vicinity of the ignition plug 25. The ignition plug 25 is thus efficiently cooled.

Further, the side edge of the exhaust-side longitudinal passage 32 is located between the exhaust valves 23, 23 of each cylinder 15 and in the vicinity of the merging point 21 of the associated exhaust ports 18, 18. Thus, the coolant flowing in the exhaust-side longitudinal passage 32 efficiently cools the exhaust ports 18, 18 and the vicinity of the exhaust ports 18, 18.

(6) Each separation wall 36 extends from the vicinity of the exhaust ports 18, 18 of the corresponding cylinder 15 toward the intake ports 14, 14. The separation wall 36 thus separates the corresponding exhaust-side lateral passage 31 from the portion of the exhaust-side longitudinal passage 32 close to the exhaust ports 18, 18 with respect to the ignition plug 25. The separation wall 36 allows communication between each exhaust-side lateral passage 31 and the exhaust-side longitudinal passage 32 at a position close to the intake ports 14, 14 with respect to the ignition plug 25. In this manner, the exhaust-side passage 27 has the two-layered structure formed by the exhaust-side lateral passages 31, which are arranged below the separation walls 36, and the exhaust-side longitudinal passage 32, which is located above the separation walls 36.

This decreases the cross-sectional area of each exhaust-side lateral passage 31 along the plane extending in the cylinder arranging direction. The flow speed of the coolant in the exhaust-side lateral passage 31 is thus increased and cooling efficiency of the corresponding ignition plug 25 and the vicinity of the associated combustion chamber 13 is improved. Further, the cross-sectional area of the exhaust-side longitudinal passage 32 along the plane perpendicular to the cylinder arranging direction is increased. This reduces the pressure loss generated by the flow of the coolant.

(7) If the cylinder head 11 is formed through casting and then the exhaust-side lateral passages 31 and the exhaust-side longitudinal passage 32 are formed in the cylinder head 11 through machining, it is necessary to provide equipment for the machining. Further, the machining needs a long time and increases the manufacturing costs. Also, if blowholes are formed through the casting, the blowholes may be connected together through the machining. This may cause leakage of coolant.

However, in the illustrated embodiment, by placing the cores in the mold for forming the cylinder head 11, the exhaust-side lateral passages 31 are the exhaust-side longitudinal passage 32, which have complicated shapes, are provided simultaneously with the cylinder head 11. This makes it unnecessary to provide the equipment and reduces the time for providing the exhaust-side lateral passages 31 and the exhaust-side longitudinal passage 32, thus advantageously decreasing the manufacturing costs. Further, mutually connected blowholes are not easily provided in the wall surfaces of the exhaust-side lateral passages 31 and the wall surface of the exhaust-side longitudinal passage 32, which correspond to the surfaces of the cores. The aforementioned leakage of the coolant is thus advantageously suppressed.

The present invention may be embodied in the other embodiments as follows.

In the illustrated embodiment, the coolant is introduced into the intake-side passage 26 of the cylinder head 11 after having passed through the water jacket formed in the cylinder block 10. However, the coolant may flow directly into the intake-side passage 26 without flowing through the cylinder block 10 after having been cooled through the heat dissipation by the radiator. This further improves anti-knocking performance and packing efficiency of intake air.

The cooling structure of the present invention may be used in a cylinder head of a multi-cylinder internal combustion engine having three or more exhaust valves for each of the cylinders 15.

In the illustrated embodiment, the exhaust-side longitudinal passage 32 has the portion close to the intake ports 14 with respect to the ignition plugs 25 and the portion close to the exhaust ports 18, 18 with respect to the ignition plugs 25. However, the exhaust-side longitudinal passage 32 may have only one of these portions.

The shape or the size of each separation wall 36 may be changed as needed as long as the separation wall 36 separates the corresponding exhaust-side lateral passage 31 from at least the portion of the exhaust-side longitudinal passage 32 close to the exhaust ports 18 with respect to the ignition plugs 25.

The invention claimed is:

1. A cooling structure of a cylinder head of an internal combustion engine having a plurality of cylinders, the cylinder head having in each of the cylinders a plurality of exhaust ports selectively opened and closed by respective exhaust valves and at least one intake port, an ignition plug being arranged in the vicinity of a top of a combustion chamber formed in each cylinder, the cylinder head including a coolant passage, the coolant passage being divided into an intake-side passage that cools a portion of the cylinder head close to the intake ports and an exhaust-side passage that cools a portion of the cylinder head close to the exhaust ports, wherein the intake-side passage is arranged below the intake ports and extends along a cylinder arranging direction, wherein the exhaust-side passage includes a plurality of exhaust-side lateral passages corresponding to the respective cylinders and an exhaust-side longitudinal passage, wherein the exhaust-side lateral passages are mutually separated by partition walls, each of the partition walls being arranged at a position corresponding to a section between the corresponding adjacent pair of the cylinders, each of the exhaust-side lateral passages having an inlet for a coolant provided in the vicinity of the exhaust ports of the corresponding one of the cylinders, each exhaust-side lateral passage extending from the inlet toward the intake port via the vicinity of the top of the combustion chamber formed in the corresponding cylinder, wherein the exhaust-side longitudinal passage extends along the cylinder arranging direction, a downstream end of each exhaust-side lateral passage being connected to the exhaust-side longitudinal passage, and wherein a separation wall is arranged between each of the exhaust-side lateral passages and the exhaust-side longitudinal passage, each of the separation walls extending from the vicinity of the exhaust ports of the corresponding one of the cylinders toward the intake port, each separation wall extending substantially horizontally and vertically separating from each other the corresponding exhaust-side lateral passage and a portion of the exhaust-side longitudinal passage close to the exhaust ports with respect to the ignition plug, each exhaust-side lateral passage communicating with the exhaust-side longitudinal passage at a position close to the intake port with respect to the ignition plug.

2. The cooling structure according to claim 1, wherein the coolant is sent from a radiator to the intake-side passage.

3. The cooling structure according to claim 1, wherein the exhaust ports of each cylinder merge together in the cylinder head, each of the inlets being provided below and in the vicinity of the merging point of the corresponding ones of the exhaust ports.

4. The cooling structure according to claim 1, wherein the exhaust-side longitudinal passage is provided above the exhaust-side lateral passages in such a manner that the exhaust-side longitudinal passage surrounds the ignition plugs.

5. The cooling structure according to claim 1, wherein the cylinder head is formed through casting, each of the exhaust-side lateral passages and the exhaust-side longitudinal passage being provided by placing cores in a mold for forming the cylinder head.

* * * * *